US007518563B2

(12) United States Patent
Lee et al.

(10) Patent No.: US 7,518,563 B2
(45) Date of Patent: Apr. 14, 2009

(54) WINDMILL-SHAPED LOOP ANTENNA HAVING PARASITIC LOOP ANTENNA

(75) Inventors: Sung-Jun Lee, Goyang-si (KR); Kwang-Chun Lee, Daejon (KR); Chi-Hyung Ahn, Goyang-si (KR); Doo-Soo Kim, Gwangju (KR); Wee-Sang Park, Pohang-si (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 11/735,169

(22) Filed: Apr. 13, 2007

(65) Prior Publication Data

US 2007/0241986 A1 Oct. 18, 2007

(30) Foreign Application Priority Data

Apr. 13, 2006 (KR) ..... 10-2006-0033770
Nov. 29, 2006 (KR) ..... 10-2006-0119015

(51) Int. Cl.
*H01Q 11/12* (2006.01)

(52) U.S. Cl. ..... 343/741; 343/742; 343/867

(58) Field of Classification Search ..... 343/741, 343/742, 866, 867, 700 MS
See application file for complete search history.

(56) References Cited

U.S. PATENT DOCUMENTS 3,427,632 A 2/1969 Vahs et al.
5,198,826 A 3/1993 Ito
2006/0001576 A1 * 1/2006 Contopanagos ..... 343/702

FOREIGN PATENT DOCUMENTS

JP 05218728 8/1993
JP 05218728 A * 8/1993
KR 1020030000791 1/2003

OTHER PUBLICATIONS

Korean Office Action for application No. 10-2006-0119015 dated Dec. 6, 2007 with English translation.
"Stacked H-Shaped Microstrip Patch Antenna"; Authors: Anguera, et al.; IEEE Transactions on Antennas and Propagation, vol. 52, No. 4, Apr. 2004.

* cited by examiner

*Primary Examiner*—Tho G Phan
(74) *Attorney, Agent, or Firm*—Muncy, Geissler, Olds, Lowe, PLLC

(57) ABSTRACT

There is provided a windmill-shaped loop antenna including: a dielectric substrate; a first radiation unit disposed on a top surface of the dielectric substrate and including a metal pattern having loop pieces; a second radiation unit disposed at a bottom surface of the dielectric substrate and including a metal pattern having loop pieces arranged not to face the loop pieces of the first radiation unit; and a plurality of identical transmission line from a center of the top and bottom surfaces of the dielectric substrate to the first and second radiation units, which form windmill-shaped metal pattern with the first and second radiation unit.

3 Claims, 9 Drawing Sheets

WINDMILL-SHAPED LOOP ANTENNA HAVING PARASITIC LOOP ANTENNA

CROSS-REFERENCE(S) TO RELATED APPLICATIONS

The present invention claims priority of Korean Patent Application Nos. 10-2006-0033770 and 10-2006-0119015, filed on Apr. 13, 2006 and Nov. 29, 2006, respectively which are incorporated herein by reference.

BACKGROUND OF THE INVENTION

1. Field of the Invention

The present invention relates to a windmill-shaped loop antenna having a parasitic loop antenna; and, more particularly, to a windmill-shaped loop antenna having a parasitic loop antenna, which has an enough loop size to use a commercial probe while sustaining omni-directional pattern having the polarization purity of ϕ-polarization only by forming windmill-shaped metal patterns formed of loop pieces on a top and a bottom surface of a dielectric substrate and arranging the loop pieces of the top surface not to face the loop pieces of the bottom surface, and controls input impedance to match to system impedance by further including a parasitic loop antenna disposed at a predetermined distance from the windmill-shaped loop antenna.

2. Description of Related Art

In order to obtain an omni-directional pattern having the polarization purity of ϕ-polarization only, an antenna must have a structure to induce a magnetic dipole. A loop antenna may equivalently have the magnetic dipole characteristics. A small loop antenna having a short electric loop length of about λ/10 sustains the magnetic dipole characteristic.

The third and fourth generation mobile communication uses a frequency band of about 2 to 6 GHz. A small loop antenna for the third and fourth generation mobile communication is required to have less than 2.4 mm of a loop radius. Such a small loop antenna has a problem of using a commercial probe for power feeding due to the short loop radius of the small loop antenna.

The small loop antenna also has a problem of matching input impedance. That is, the small loop antenna has a bad antennal efficiency although a circuit for matching impedances is additionally used.

Therefore, there is a demand for an antenna structure that allows the physical length of loops and the impedance with an antenna radiation resistance to control while sustaining an omni-directional small loop antenna pattern with ϕ-polarization only.

According to a conventional loop antenna technology, a loop antenna having a loop rolled up several times was introduced. Such a rolled-up loop increases the radiation resistance and performs impedance matching. However, the conventional loop antenna with the rolled-up loop has problems of reducing the polarization purity and breaking the omni-directional pattern.

According to another conventional loop antenna technology, another loop antenna using coaxial cable pieces was introduced to only obtain the ϕ-polarized pattern regardless of the electric length of the loop. However, it is difficult to embody the conventional loop antenna with coaxial cable pieces to be operated at a frequency higher than 2 GHz and has the limitation for impedance matching because the conventional loop antenna with coaxial cable pieces is not a thin film structure.

SUMMARY OF THE INVENTION

An embodiment of the present invention is directed to providing a windmill-shaped loop antenna having a parasitic loop antenna, which has an enough loop size to use a commercial probe while sustaining omni-directional pattern having the polarization purity of ϕ-polarization only by forming windmill-shaped metal patterns formed of loop pieces on a top and a bottom surface of a dielectric substrate and arranging the loop pieces of the top surface not to face the loop pieces of the bottom surface, and controls input impedance to match to system impedance by further including a parasitic loop antenna disposed at a predetermined distance from the windmill-shaped loop antenna.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an aspect of the present invention, there is provided a windmill-shaped loop antenna including: a dielectric substrate; a first radiation unit disposed on a top surface of the dielectric substrate and including a metal pattern having loop pieces; a second radiation unit disposed at a bottom surface of the dielectric substrate and including a metal pattern having loop pieces arranged not to face the loop pieces of the first radiation unit; and a plurality of identical transmission line from a center of the top and bottom surfaces of the dielectric substrate to the first and second radiation units, which form windmill-shaped metal pattern with the first and second radiation unit.

DESCRIPTION OF SPECIFIC EMBODIMENTS

The advantages, features and aspects of the invention will become apparent from the following description of the embodiments with reference to the accompanying drawings, which is set forth hereinafter.

Figure 1A:
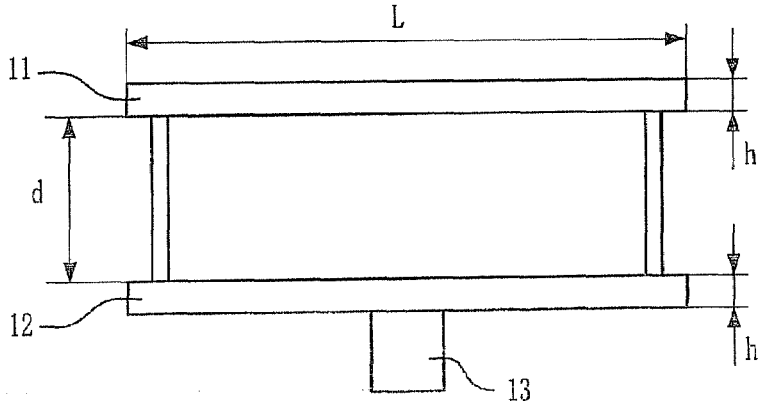
FIG. 1A is a front view of a windmill-shaped loop antenna having a parasitic loop antenna according to an embodiment of the present invention.
Figure 1B:
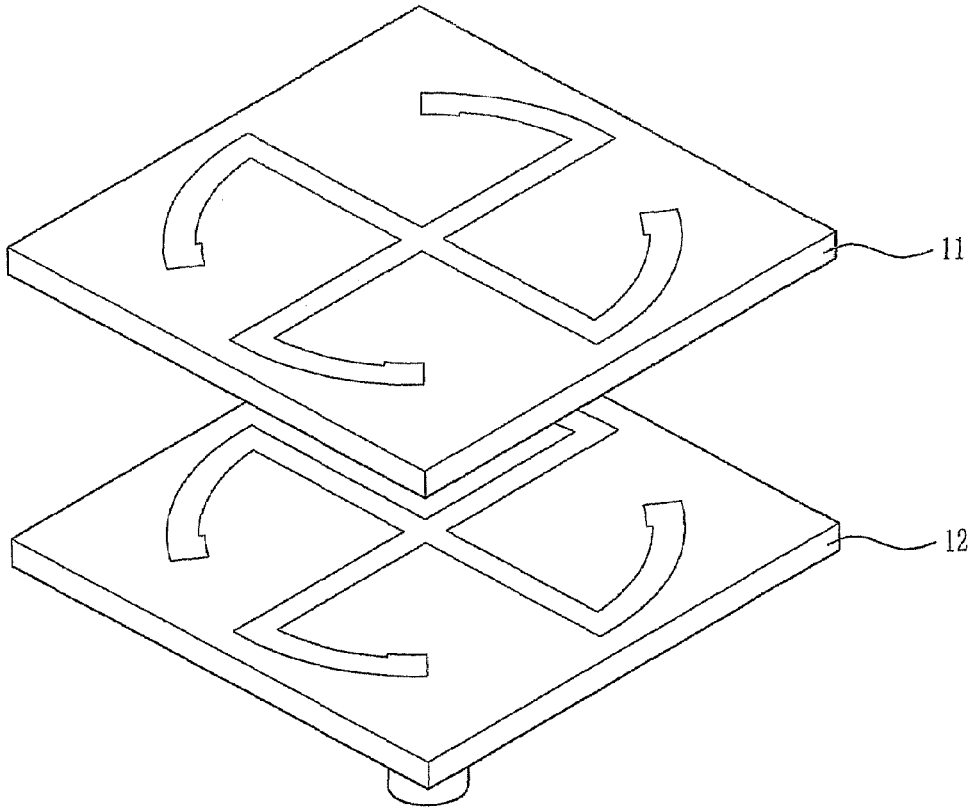
FIG. 1B is a perspective view of a windmill-shaped loop antenna having a parasitic loop antenna according to an embodiment of the present invention.

FIG. 1A is a front view of a windmill-shaped loop antenna having a parasitic loop antenna according to an embodiment of the present invention, and FIG. 1B is a perspective view of a windmill-shaped loop antenna having a parasitic loop antenna according to an embodiment of the present invention;

As shown in FIGS. 1A and 1B, the windmill-shaped loop antenna according to an embodiment of the present invention includes a parasitic loop antenna 11, and a lower loop antenna 12. As shown in FIG. 1A, 'd' denotes a distance between the lower loop antenna 12 and the parasitic loop antenna 11, 'h' denotes a thickness of the substrate of the parasitic loop antenna 11 or the lower loop antenna 12, and 'L' denotes a length of a rectangle substrate.

As shown in FIG. 1B, the windmill-shaped loop antenna according to the present embodiment has windmill-shaped metal patterns etched on substrates. In more detail, the windmill-shaped loop antenna includes four transmission lines disposed on a top and a bottom surface of each substrate of the parasitic loop antenna 11 and the lower loop antenna 12, and loop pieces connected to the ends of the transmission lines. In overall, the windmill-shaped loop antenna according to the present embodiment has the shape of windmill-shaped loop antenna formed by the transmission lines with the loop pieces in overall.

Figure 2A:
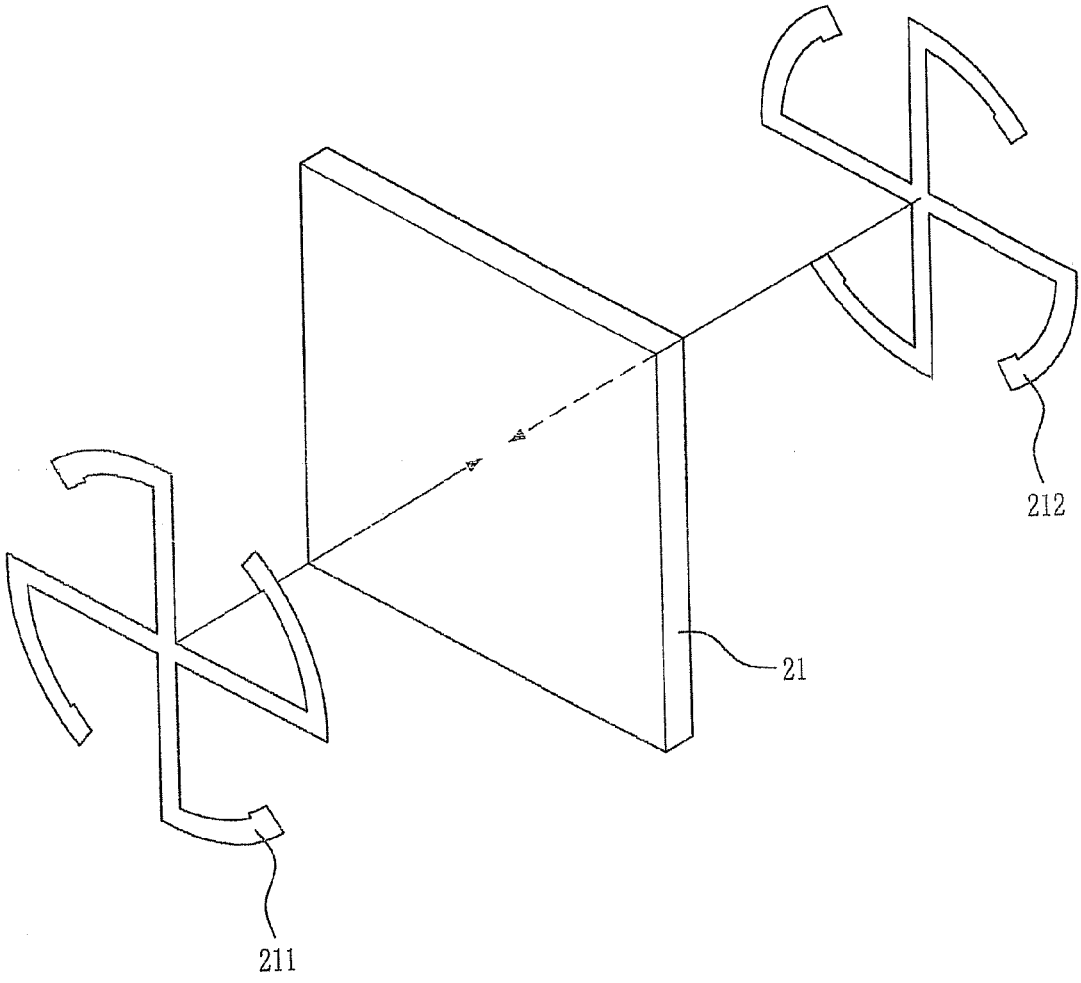
FIG. 2A is a diagram illustrating a parasitic loop antenna according to an embodiment of the present invention.
Figure 2B:
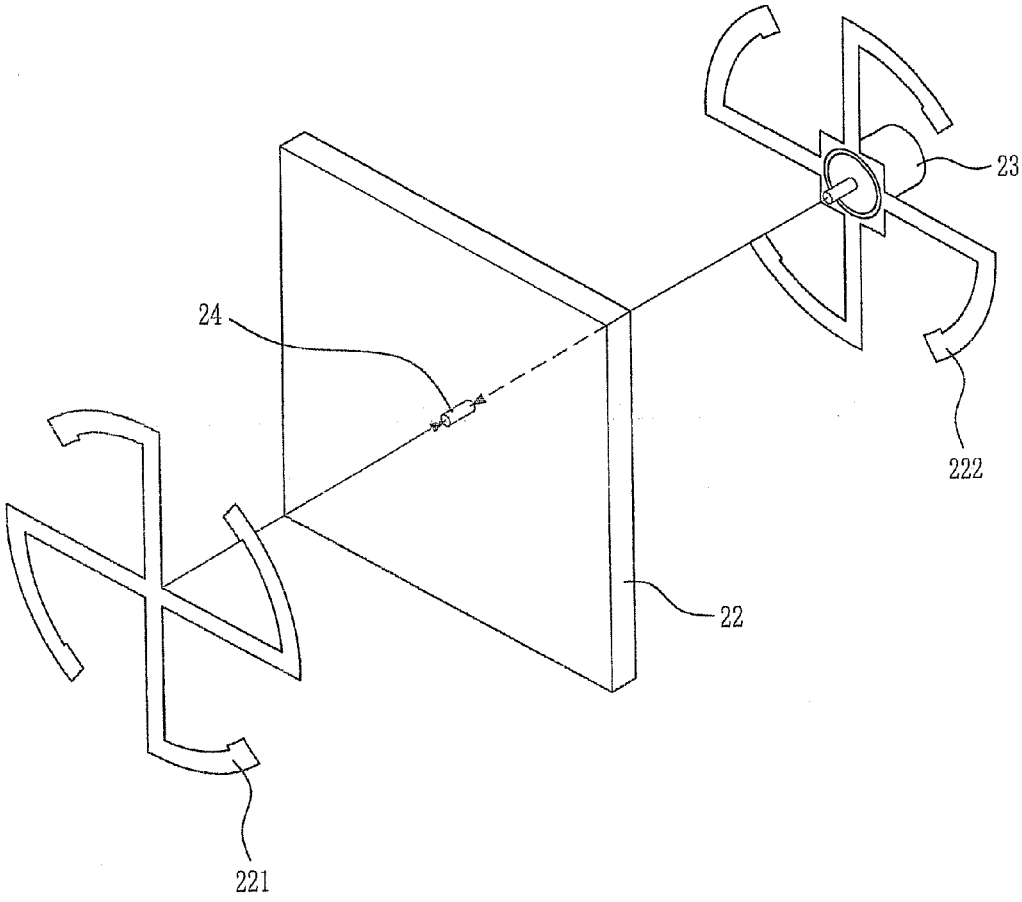
FIG. 2B is a diagram illustrating a lower loop antenna according to an embodiment of the present invention.

FIG. 2A is a diagram illustrating a parasitic loop antenna according to an embodiment of the present invention, and FIG. 2B is a diagram illustrating a lower loop antenna according to an embodiment of the present invention.

As shown in FIG. 2A, the parasitic loop antenna 11 includes a parasitic loop antenna substrate 21, and windmill shaped metal patterns 211, and 212. The metal patterns 211 and 212 are symmetrically etched on the top and bottom surfaces of the parasitic loop antenna substrate 21.

As shown in FIG. 2B, the lower loop antenna 12 includes a lower loop antenna substrate 22, windmill-shaped metal patterns 221 and 222, a probe 23 for power feeding, and a via 24 for inserting the probe 23.

Hereinafter, a windmill-shaped loop antenna having eight loop pieces according to an embodiment of the present invention will be described. Although the electric length of an entire loop formed of eight loop pieces is comparatively long, the electric length of each loop piece may be short. That is, in order to balance the current on the loop pieces, a loop having a long electric length is formed using loop pieces each having a short electric length. Also, the current on the eight loop pieces direct the same direction at the same time to distribute the current on an entire loop identical to that on a small loop antenna. The windmill shaped loop antenna formed of eight loop pieces according to the present embodiment has an omni-directional pattern of ϕ-polarization, which a typical small loop antenna has.

Figure 3A:
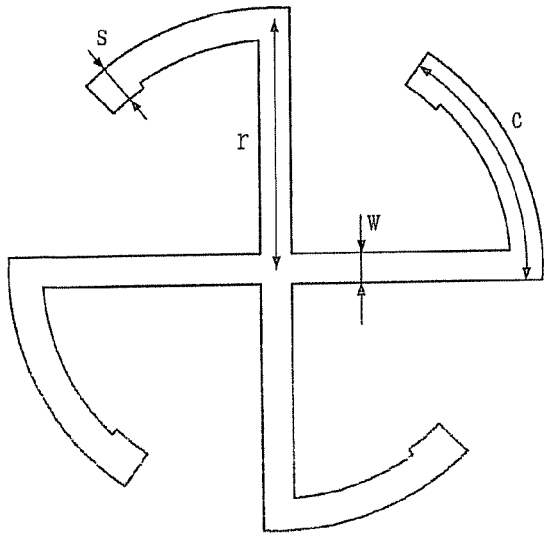
FIG. 3A is a diagram illustrating a windmill-shaped metal pattern disposed on a top surface of a parasitic loop antenna substrate according to an embodiment of the present invention.
Figure 3B:
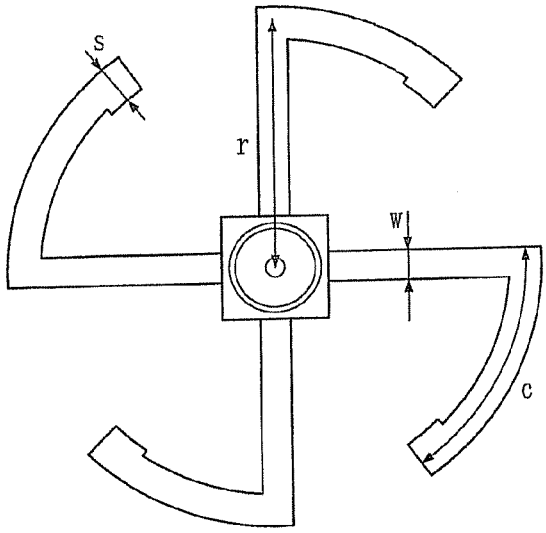
FIG. 3B is a diagram illustrating a windmill shaped metal pattern disposed at the bottom surface of the lower loop antenna substrate according to an embodiment of the present invention.

FIG. 3A is a diagram illustrating a windmill-shaped metal pattern disposed at the top of the lower loop antenna substrate and both of the parasitic loop antenna according to an embodiment of the present invention, and FIG. 3B is a diagram illustrating a windmill shaped metal pattern disposed at the bottom surface of the lower loop antenna substrate according to an embodiment of the present invention.

As shown in FIGS. 3A and 3B, 's' denotes the length of a stub, 'r' denotes a radius of a loop, 'c' denotes the length of each loop piece, and 'w' denotes a width of the transmission line.

The input impedance of the lower loop antenna 12 can be controlled by adjusting a stub length s, a loop radius r, a loop piece length c, a transmission line width w, and the number N of transmission lines, for example, N=4.

In the present embodiment, the input impendence of the windmill shaped loop antenna can be controlled according to a distance between the parasitic loop antenna 11 and the lower loop antenna 12. Herein, the omni-directional pattern of ϕ-polarization can be sustained using the parasitic loop antenna 11 having the same structure of the lower loop antenna 12.

Figure 4A:
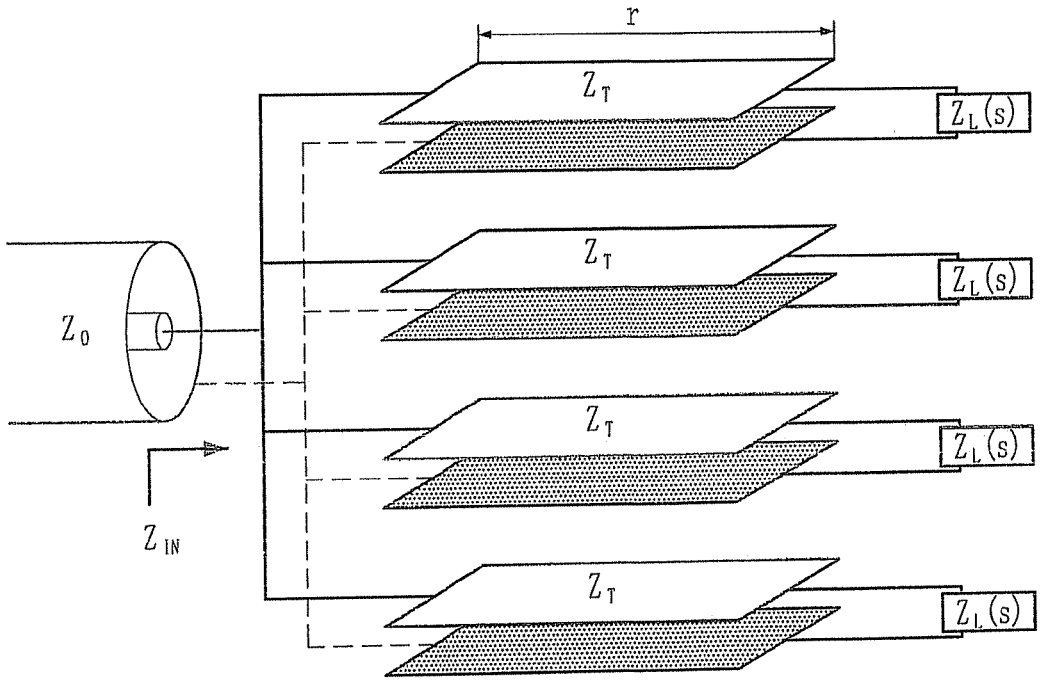
FIG. 4A is a diagram illustrating a model equivalent to transmission lines of a lower loop antenna only according to an embodiment of the present invention.

FIG. 4A is a diagram illustrating an equivalent transmission lines model of a lower loop antenna according to an embodiment of the present invention.

Hereinafter, the input impedance of the lower loop antenna will be described in a view of eight loop pieces connected to four parallel transmission lines. The input impedance of the lower loop antenna 12 can be expressed as Eq. 1 when the dielectric constant of the substrate, the substrate thickness h, the transmission line width w, the loop radius r, and the length c of the loop piece are decided. Herein, N denotes the number of transmission lines.

$$Z_{IN}(s) = \frac{1}{N}\left(Z_T \frac{Z_L(s) + jZ_T\tan(\beta r)}{Z_T + jZ_L(s)\tan(\beta r)}\right) = R_{IN}(s) + jX_{IN}(s) \quad \text{Eq. 1}$$

In Eq. 1, '$Z_{IN}(s)$' denotes an input impedance, '$Z_T$' denotes the impedance characteristics of the transmission line, '$Z_L(S)$' denotes the impedance of two loop pieces connected to each transmission line, and N denotes the number of the transmission lines. In case of the present embodiment, N is 4. 's' denotes the length of the stub connected to the end of the loop piece, 'r' denotes a radius, '$R_{IN}(S)$' is an input resistance, and '$jX_{IN}(s)$' denotes an input reactance.

The length s of the stub connected to the end of the each loop piece performs a function of controlling the capacitive loading. Therefore, the stub length s is expressed as an input variable that can control the input impedance. Although $Z_L(s)$ is a function of N, $Z_L(s)$ is expressed as the function of s because s affects the input impedance greater than N.

The current distribution on the entire loop formed of the loop pieces can be sustained similar to that of the small loop antenna by shortening the length c of the loop piece and increasing the number N of the transmission lines as the frequency increases because the physical size of the antenna needs to be maintained at a predetermined size.

In this case, the antenna input impedance decreases according to Eq. 1. In order to solve this problem, it needs to increase $Z_L(s)$. Since there is a limitation to increase $Z_L(s)$ by controlling the stub length s, there is also a limitation to match impedances.

According to the present embodiment, the input impedance of the antenna is controlled using the parasitic loop antenna 11. The structure and the size of the parasitic loop antenna 11 are identical to the lower loop antenna 12. Making the parasitic loop antenna 11 identical to the lower loop antenna 12, the same current is excited at the parasitic loop antenna when inductive coupling is induced, thereby further stabilizing the radiation pattern at the azimuth angle plane.

Figure 4B:
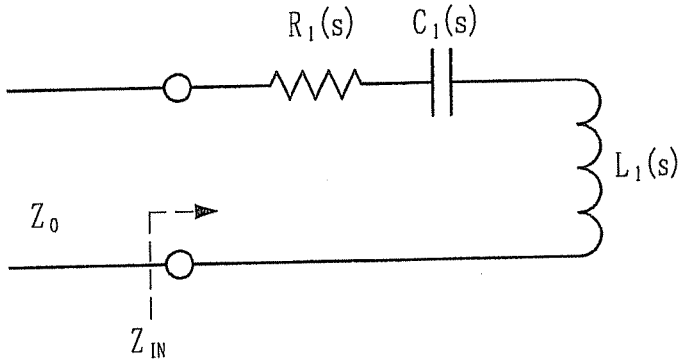
FIG. 4B is a diagram illustrating a circuit equivalent to a lower loop antenna according to an embodiment of the present invention.

FIG. 4B is a circuit diagram equivalent to a lower loop antenna according to an embodiment of the present invention.

As shown in FIG. 4B, the lower loop antenna 12 is equivalently modeled with a resistance, an inductor, and a capacitor. The inductor is modeled for mutual inductive coupling, and the capacitor is additionally modeled in consideration of negative reactance components.

Eq. 2 expresses the input impedance $Z_1(s)$ of the lower loop antenna 12. Typical antennas can be expressed as an equivalent circuit like as Eq. 2. The equivalent circuit of the windmill-shaped loop antenna having a parasitic loop antenna will be described with reference to Eq. 2.

The input impedance $Z_1(s)$ of the lower loop antenna 12 without the parasitic loop antenna can be induced from Eq. 1 and expressed as Eq. 2.

$$Z_{IN}(s) = R_{IN}(s) + jX_{IN}(s) = R_1(s) + \frac{1}{j2\pi fC_1(s)} + jf2\pi fl_1(s) = Z_1(s) \quad \text{Eq. 2}$$

In Eq. 2, '$R_{IN}(s)$' is input resistance components, '$jX_{IN}(s)$'c is an input reactance component, '$R_1(s)$' is a resistance component of the lower loop antenna 12. '$1/j2\pi fC_1(s)$' denotes a capacitance reactance component, and '$2\pi fL_1(s)$' is inductive reactance component.

Figure 4C:
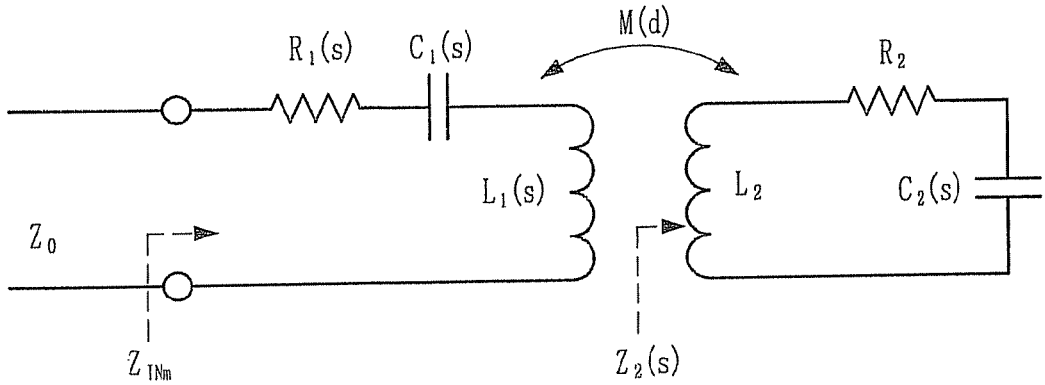
FIG. 4C is a diagram illustrating a circuit equivalent to a windmill-shaped loop antenna having a parasitic loop antenna according to an embodiment of the present invention.

FIG. 4C is a diagram illustrating an equivalent circuit of a windmill-shaped loop antenna having a parasitic loop antenna according to an embodiment of the present invention.

As shown in FIG. 4C, the input impedance of a windmill shaped loop antenna having the parasitic loop antenna 11 according to the present embodiment can be expressed as Eq. 3.

$$Z_{INm}(s, d) = Z_1(s) + \frac{(2\pi f)^2 M(d)^2}{Z_2(s)} = R_{1Nm}(s, d) + jX_{1Nm}(s, d) \quad \text{Eq. 3}$$

In Eq. 3, '$Z_2(s)$' denotes the input impedance of the parasitic loop antenna 11, '$Z_1(s)$' denotes the input impedance of the lower loop antenna 12, '$R_{INm}(s,d)$' is input resistance component, and '$jX_{INm}(s,d)$' denotes the input reactance component.

In the present embodiment, the input resistance component $R_{INm}(s,d)$ and the input reactance component $jX_{INm}(s,d)$ control the intensity of inductive coupling according to the distance d between the lower loop antenna 12 and the parasitic loop antenna 11. In the present embodiment, the distance d is used to increase the input resistance. Also, the desired resonant frequency, for example, 2.6 GHz, can be obtained by controlling the input reactance $jX_{1Nm}(s,d)$ using the stub length s in the present embodiment.

Eq. 4 expresses the input impedance '$Z_2(s)$' of the parasitic loop antenna 11 as follows.

$$Z_2(s) = R_2(s) + \frac{1}{j2\pi fC_2(s)} + j2\pi fL_2 \quad \text{Eq. 4}$$

In Eq. 4, '$R_2(s)$' denotes the resistance component of the top parasitic loop antenna 11, and '$1/2\pi fC_2(s)$' denotes the capacitance reactance component of the parasitic loop antenna 11, and '$2\pi fL_2$' denotes an inductive reactance component of the parasitic loop antenna 11.

The inductive coupling intensity M(d) is controlled by adjusting the distance d between the lower loop antenna 12 and the parasitic loop antenna 11. As a result, the input resistance $R_{1Nm}(s,d)$ and the input reactance $jX_{1Nm}(s,d)$ of the windmill-shaped loop antenna having the parasitic loop antenna 11 can be controlled using the distance d.

Therefore, the input impedance can be controlled using the stub length s and the distance d between the antennas in the present embodiment. In the present embodiment, the parasitic loop antenna 11 is used to increase input resistance.

Hereinafter, the simulation result of the windmill shaped loop antenna having the parasitic loop antenna according to the present embodiment, obtained using a finite difference time domain (FDTD) based commercial simulation tool such as MWS of CST, will be described. The simulation is performed using the target frequency of 2.6 GHz, and parameters shown in Table 1, and input impedances at about 2.6 GHz are shown in Table 2.

TABLE 1

| | symbol | | | | |
|---|---|---|---|---|---|
| | $\in_r$ | H | L | w | r |
| description | dielectric constant of substrate | thickness of substrate | length of rectangular substrate | width of trans-mission line | radius of loop |
| value | 2.2 | 1.6 mm | 35.4 mm | 2 mm | 16.3 mm |

| | symbol | | | |
|---|---|---|---|---|
| | C | N | S | d |
| description | length of loop piece | number of transmission lines | length of stub | distance between antennas |
| value | 14 mm (=0.12λ@2.6 GHz) | 4 | variable | variable |

TABLE 2

| | D | | | | | |
|---|---|---|---|---|---|---|
| | 5 mm | | 6 mm | | 7 mm | |
| S | $R_{INm}$ | $X_{INm}$ | $R_{INm}$ | $X_{INm}$ | $R_{INm}$ | $X_{INm}$ |
| 2.0 mm | 45.0 | 24.8 | 38.0 | 34.6 | 32.6 | 38.0 |
| 2.5 mm | 40.6 | −4.4 | 46.8 | 3.6 | 48.0 | 13.5 |
| 3.0 mm | 20.2 | −9.4 | 26.3 | −8.4 | 32.5 | −6.0 |

Table 2 shows input impedances according to the stub length s, and the distance between the lower loop antenna 12 and the parasitic loop antenna 11 for impedance matching. As shown in Table 2, the impedances are matched when the stub length s is 2.5 mm and the distance d between the lower loop antenna 12 and the parasitic loop antenna 11 is 6 mm.

Figure 5:
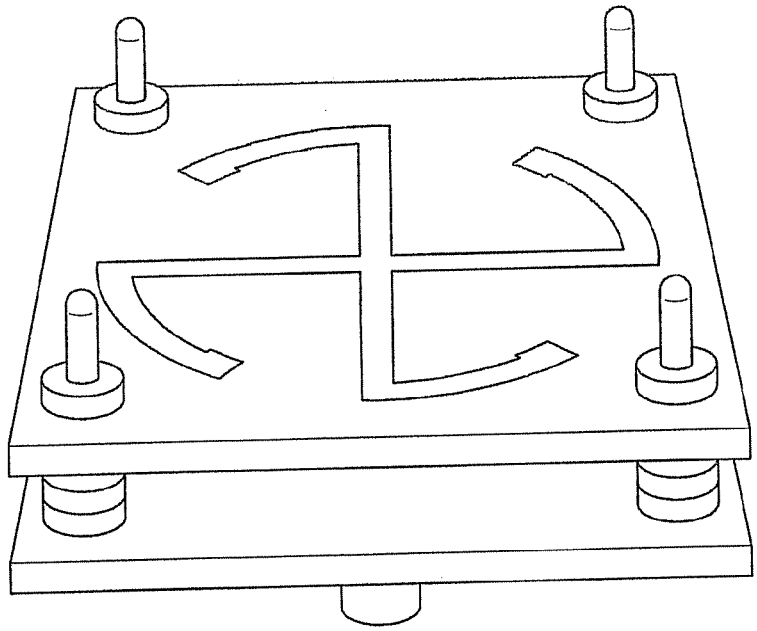
FIG. 5 is a picture illustrating a prototype of a windmill shaped loop antenna having a parasitic loop antenna according to an embodiment of the present invention.

FIG. 5 is a picture of a windmill shaped loop antenna having a parasitic loop antenna according to an embodiment of the present invention.

As shown in FIG. 5, the prototype model of the windmill-shaped loop antenna having the parasitic antenna 11 according to the present embodiment is manufactured by applying the stub length s of 2.5 mm and the distance between the lower loop antenna 12 and the parasitic antenna 11 of 6 mm at table 1.

Figure 6:
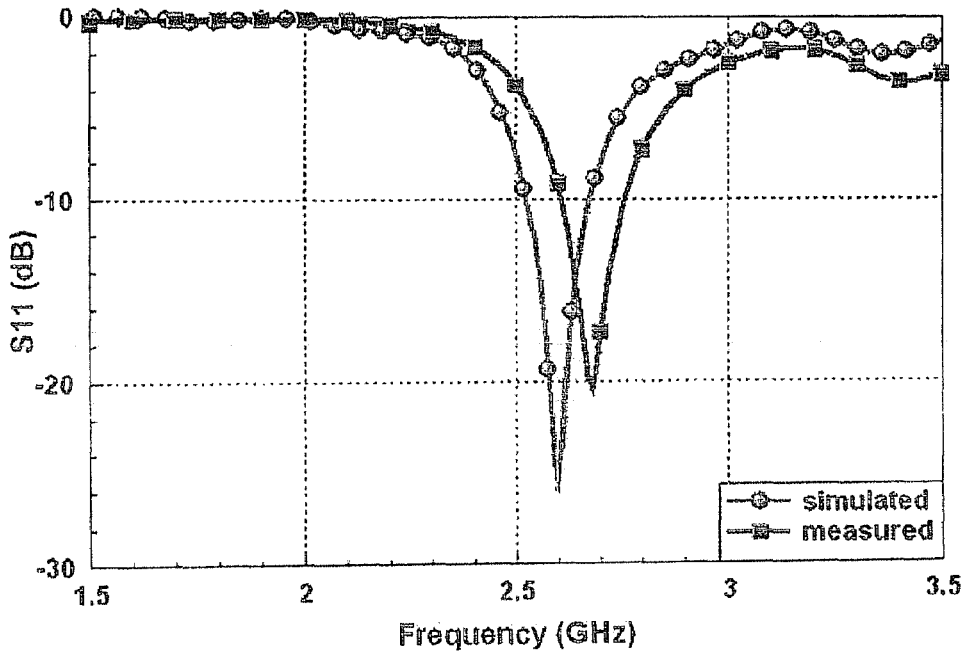
FIG. 6 is a graph showing a result of measuring a reflection coefficient of a windmill shaped antenna having a parasitic loop antenna and a simulation result of the same according to an embodiment of the present invention.

FIG. 6 is a graph showing a result of measuring a reflection coefficient of a windmill shaped antenna having a parasitic loop antenna and a simulation result of the same according to an embodiment of the present invention.

As shown in FIG. 6, according to the measuring result and the simulation result of the reflection coefficient, the windmill-shaped loop antenna according to the present embodiment has about 6% of impedance bandwidth with the target frequency of 2.6 GHz as the reference based on standing-wave ratio less than 2:1.

Figure 7A:
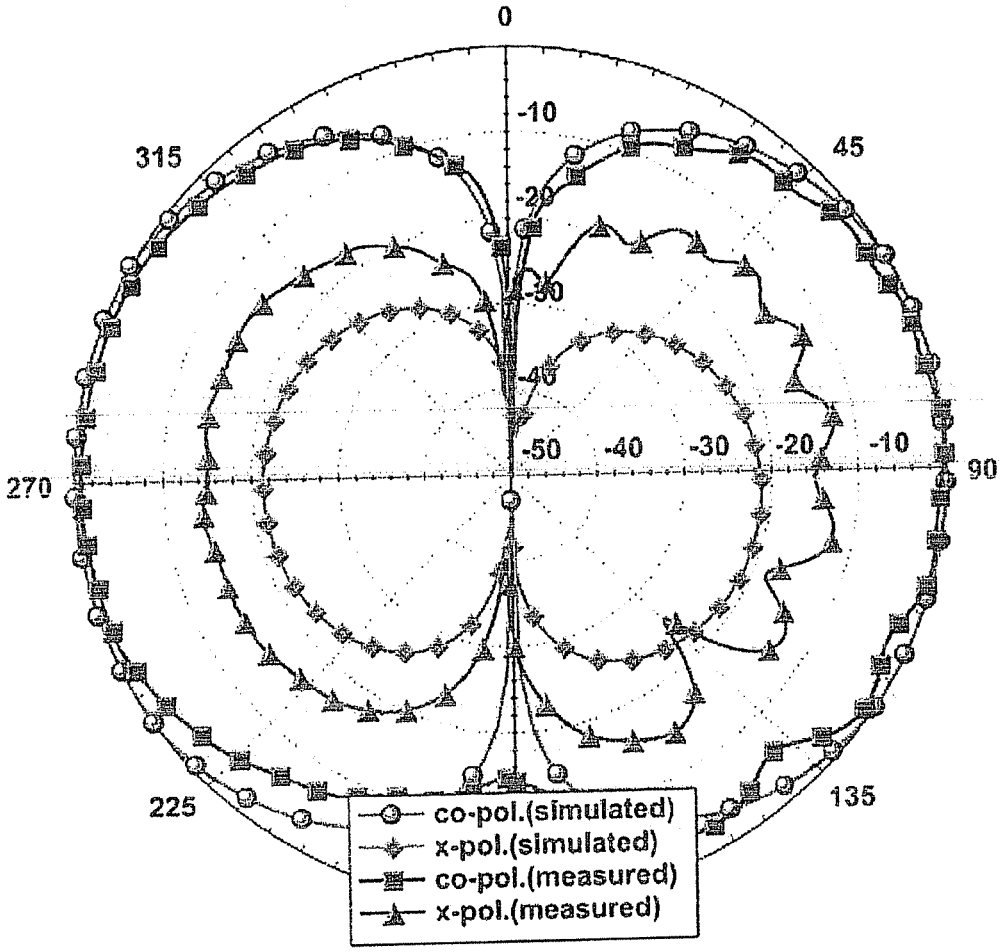
FIGS. 7A and 7B are graphs illustrating a result of measuring an elevation angle direction pattern and an azimuth angle direction pattern of a windmill-shaped loop antenna having a parasitic loop antenna according to an embodiment of the present invention and a simulation result of the same.
Figure 7B:
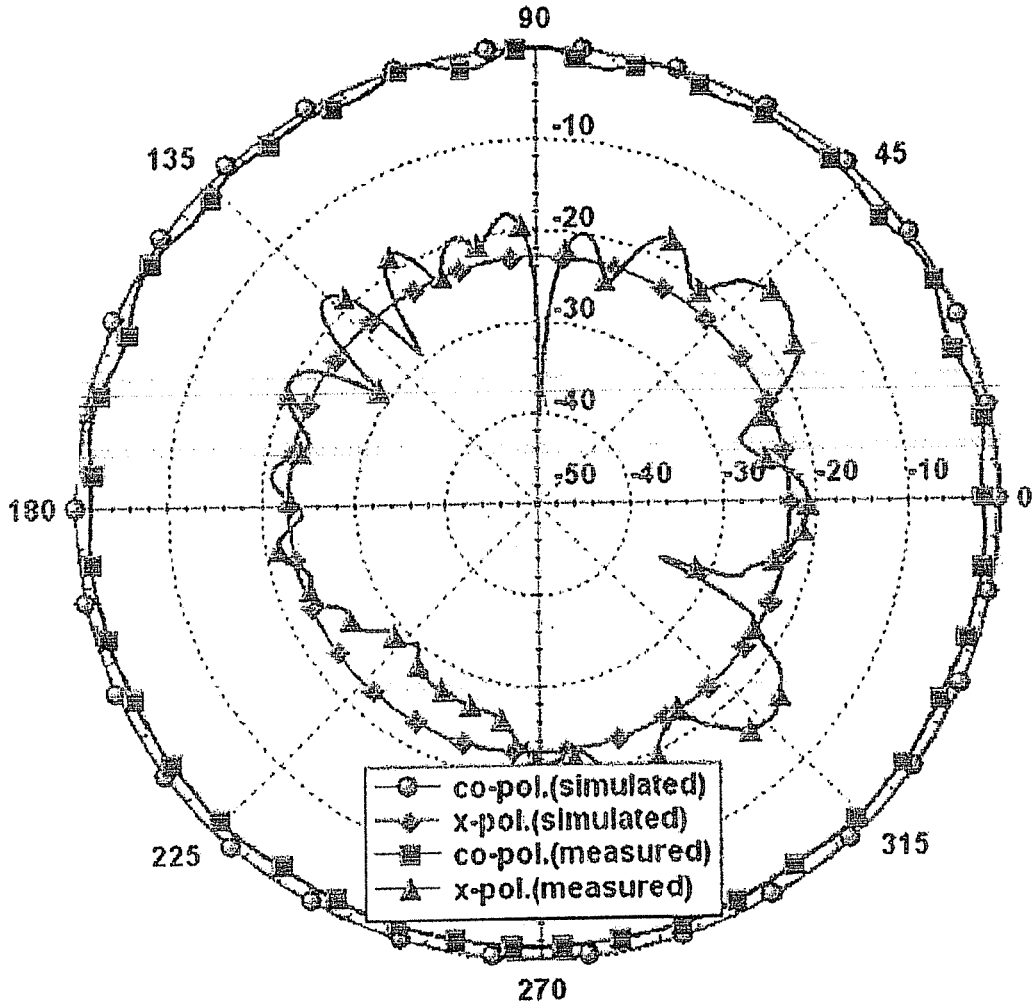

FIGS. 7A and 7B are graphs illustrating a result of measuring an azimuth angle pattern and a simulation result of the same according to an embodiment of the present invention.

As shown in FIG. 7A, the simulation result and the measuring result of co-polarization $E_{\varnothing}$ at the azimuth plane are comparatively matched. The simulation result and the measuring result of cross-polarization $E_{\theta}$, however, are not matched. It is because of measuring error caused by a cable.

Based on the measuring result, the windmill-shaped loop antenna having the parasitic loop antenna has about 15 dB of polarization purity.

While the present invention has been described with respect to certain preferred embodiments, it will be apparent to those skilled in the art that various changes and modifications may be made without departing from the spirits and scope of the invention as defined in the following claims.

As described above, the windmill-shaped loop antenna according to the certain embodiment of the present invention includes the lower loop antenna having the windmill-shaped structures symmetrically disposed on the top and bottom surfaces of the substrates, and the windmill-shaped loop antenna according to the present invention has an enough physical size of the loop to use a commercial feeding probe at a frequency higher than 2 GHz while having an omni-directional small loop antenna pattern with the polarization purity of ϕ-polarization only.

The windmill-shaped loop antenna according to the present invention can solve the impedance matching problem and the antenna efficiency problem of conventional small loop antenna using the parasitic loop antenna having the same structure of the lower loop antenna and disposed at a predetermined distance from the lower loop antenna.

Moreover, the windmill-shaped loop antenna according to the present invention has an omni-directional small loop antenna pattern.

Therefore, the windmill-shaped loop antenna according to the present invention can be used as polarization diversity antenna with a dipole antenna for the next generation mobile communication having a target frequency from about 2 to 6 GHz.

Furthermore, since the windmill-shaped loop antenna according to the present invention has less variable parameters such as the stub length s and the distance d between the lower loop antenna and the parasitic loop antenna. Therefore, it is easy for parametric study and to embody an actual design guide.

What is claimed is:

1. A windmill-shaped loop antenna comprising:

a dielectric substrate;

a first radiation unit disposed on a top surface of the dielectric substrate and including a metal pattern having loop pieces;

a second radiation unit disposed at a bottom surface of the dielectric substrate and including a metal pattern having loop pieces arranged not to face the loop pieces of the first radiation unit; and a plurality of identical transmission lines from a center of the top and bottom surfaces of the dielectric substrate to the first and second radiation units, which form windmill-shaped metal pattern with the first and second radiation unit.

2. The windmill-shaped loop antenna as recited in claim 1, wherein each of the first and second radiation units has a stub connected to an end of the each loop pieces for controlling input impedance.

3. The windmill-shaped loop antenna as recited in claim 1, further comprising a parasitic loop antenna having a structure identical to the windmill-shaped loop antenna, and disposed at a predetermined distance from the windmill-shaped loop antenna for controlling input impedance through mutual inductive coupling.

* * * * *